US010004335B2

(12) United States Patent
Ballendat

(10) Patent No.: US 10,004,335 B2
(45) Date of Patent: Jun. 26, 2018

(54) PIECE OF FRAME FURNITURE HAVING A SUPPORT FRAME

(71) Applicant: Jakob Gauger Söhne Stuhl- und Tischfabrik, Innenausbau GmbH & Co, Mössingen (DE)

(72) Inventor: Martin Ballendat, Braunau am Inn (AT)

(73) Assignee: JAKOB GAUGER SÖHNE STUHL-UND TISCHFABRIK, INNENAUSBAU GMBH & CO., Mössingen (DE)

( * ) Notice: Subject to any disclaimer, the term of this patent is extended or adjusted under 35 U.S.C. 154(b) by 0 days. days.

(21) Appl. No.: 15/118,372

(22) PCT Filed: Feb. 10, 2015

(86) PCT No.: PCT/EP2015/052754

§ 371 (c)(1),
(2) Date: Aug. 11, 2016

(87) PCT Pub. No.: WO2015/121250

PCT Pub. Date: Aug. 20, 2015

(65) Prior Publication Data

US 2017/0164744 A1 Jun. 15, 2017

(30) Foreign Application Priority Data

Feb. 13, 2014 (DE) ..... 10 2014 101 825

(51) Int. Cl.
*A47C 3/04* (2006.01)
*A47C 7/00* (2006.01)
*A47C 5/04* (2006.01)

(52) U.S. Cl.
CPC ..... *A47C 3/04* (2013.01); *A47C 5/043* (2013.01); *A47C 7/002* (2013.01)

(58) Field of Classification Search
CPC ..... A47C 5/043; A47C 3/04; A47C 7/002
(Continued)

(56) References Cited

U.S. PATENT DOCUMENTS 4,676,553 A 6/1987 Lange
2003/0090140 A1* 5/2003 Belic ..... A47C 5/04 297/452.19
2008/0277982 A1* 11/2008 Bartlmae ..... A47C 1/124 297/239

FOREIGN PATENT DOCUMENTS

DE 7810513 U1 11/1978
DE 202014100096 U1 1/2015
(Continued)

OTHER PUBLICATIONS

International Search Report dated Jun. 25, 2015 PCT/EP2015/052754.

*Primary Examiner* — Milton Nelson, Jr.
(74) *Attorney, Agent, or Firm* — King & Schickli, PLLC

(57) ABSTRACT

The invention relates to a frame furniture comprising a furniture element (14) being plate-shaped at least in some areas and having an at least partially nearly horizontal extension and being arranged on a carrier frame (18) which has a leg element (20A, 20B) on both sides, respectively, regarding a vertical furniture median plane, the leg element (20A, 20B) consisting of a tubular element bent in such a way that the tubular element forms a front and rear furniture leg (22A, 22B, 24A, 24B). The tubular elements each have an elliptical or oval cross section having a long major axis and a short minor axis, wherein the major axis and the minor axis intersect with the vertical furniture median plane over the length of the particular tubular element at an angle less than 90°.

14 Claims, 8 Drawing Sheets

(58) Field of Classification Search
USPC ..... 297/452.2, 239
See application file for complete search history.

(56) References Cited

FOREIGN PATENT DOCUMENTS

| | | | | | |
|---|---|---|---|---|---|
| EP | 0098493 | A2 | | 1/1984 | |
| GB | 930158 | A1 | | 7/1963 | |
| GB | 1045716 | A | | 10/1966 | |
| WO | WO 9736519 | A1 | * | 10/1997 | ..... A47C 1/124 |

* cited by examiner

PIECE OF FRAME FURNITURE HAVING A SUPPORT FRAME

FIELD OF THE INVENTION

The invention relates to a frame furniture comprising the features of the generic term of claim 1.

BACKGROUND OF THE INVENTION

From practice, such a frame furniture is known as a chair for example and comprises a carrier frame on which a seat shell is arranged which focus a seating element and a backrest element. The carrier frame comprises a chair leg element on each side with regard to a vertical chair longitudinal median plane, said chair leg element being formed from a curved tubular element with a circular cross section thus forming a front and a rear chair leg. Both of the chair leg elements are connected by a cross-piece which runs along the chair transverse direction and serves to support the seat shell. The frame furniture can be formed as a stacking chair, wherein the respective stacking height or stacking space between two chairs stacked on top of each other is defined by a circular cross section of the tubular elements.

SUMMARY OF THE INVENTION

The object of this invention is to provide a frame furniture mentioned above which is optimally formed with regard to its stacking height.

The object is inventively attained by the frame furniture comprising the features of claim 1.

The frame furniture according to the invention comprises a furniture element arranged on a carrier frame which, with regard to the vertical median plane, has a leg element on each side which is formed by a tubular element curved in such a way that it forms a first and a second furniture leg. The tubular elements comprise an elliptic or oval cross section, respectively, with a long major axis and a short minor axis, wherein the major axis and the minor axis intersect with the vertical furniture median plane over the length of the particular tubular element at an angle of less than 90°.

Thus, the core of the invention consists in the curved tubular elements having an elliptic or oval, i.e. non-circular, cross section and the curvature of the tubular elements occurring not via the major axis or minor axis of the ellipse fowled by the cross section of the tubular elements at the apex but instead occurring via an axis between the corresponding minor axis and the corresponding major axis. This axis is at least largely positioned in the transverse direction regarding the vertical median plane, whereas an axis positioned perpendicular to this axis lies on a plane which is spanned by the major axis of the corresponding tubular element. Thereby a small stacking space between frame furniture of the same make can be created. Simultaneously, the tubular elements act as a kind of cone which exactly aligns the frame furniture to each other when stacked.

The term "elliptic" is to be understood in its broadest sense, i.e. not in a strictly mathematical sense. In fact, the term describes that the tubular element does not have a circular cross section but a rather flattened round cross section. The longest diameter is formed by the major axis whereas the smallest diameter is formed by the minor axis which is positioned perpendicular to the major axis.

The frame furniture according to the invention is a chair, for example, in which the furniture element is a seating element forming the seating area, or a table in which the furniture element is a tabletop.

In a preferred embodiment of the frame furniture according to the invention, the major axis points upward in the direction of the furniture median plane over the length of the corresponding tubular element and the minor axis points downward in direction of the furniture median plane over the length of the corresponding tubular element. The contact surface formed by the two leg elements when stacking the frame furniture points to the inside at the bottom of the tubular element, i.e. in direction of the median plane, and up, i.e. at its visible side, away from the median plane.

With regard to the stackability of the frame furniture, a major axis has proven to be particularly suitable which intersects the vertical median plane at an angle between 30° and 60°.

The furniture legs of a leg element formed by the same tubular element diverge in direction to a floor area, i.e. downward. In particular, the leg elements form a symmetric or asymmetric inverted V with a curved section at the top.

It is possible that the leg elements serve directly as a carrier for the furniture elements. Preferably, however, the leg elements are connected to each other via at least one cross-piece on which the furniture element is fixed.

In order to attain a perfect stackability of the frame furniture according to the invention, the two leg elements span expediently at least largely parallel planes.

In order to attain a mostly rattle-free storage of the frame furniture when stacked, a stacking buffer can be provided which is expediently encompassed by the curved section forming a section of the respective tubular element which is between the two furniture legs of the respective leg element.

The stacking buffer can comprise a linking element which can link a frame furniture with another frame furniture of the same make.

In order to facilitate the stacking process, the furniture legs can comprise a stacking guide at each of their end sections, said stacking guide lying on the furniture leg of a frame furniture of the same make when stacked.

The stacking buffer and the stacking guides, respectively, are preferably each made of a plastic element. The stacking buffers can be produced in one piece with a foot insert of the respective furniture leg.

Further advantages and advantageous embodiments of the frame furniture according to the invention can be derived from the description, the drawing and the Claims.

BRIEF DESCRIPTION OF THE DRAWING FIGURES

Embodiments of a frame furniture according to the invention are shown in the drawing in a schematic simplified form and are further explained in the following description. In the figures FIG. 1 shows a perspective front view of two chairs according to the invention when stacked;

DETAILED DESCRIPTION OF THE INVENTION

Figure 1:
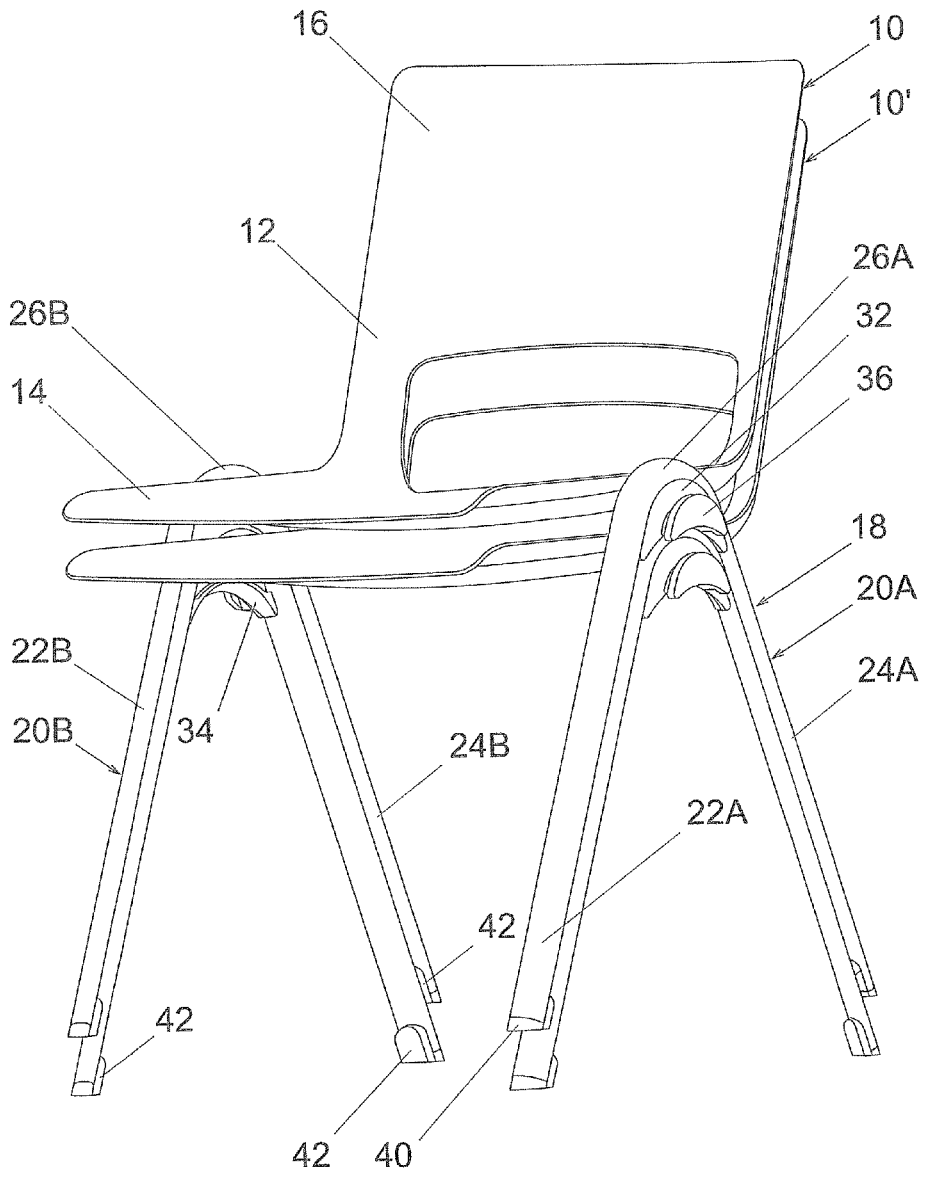
Figure 2:
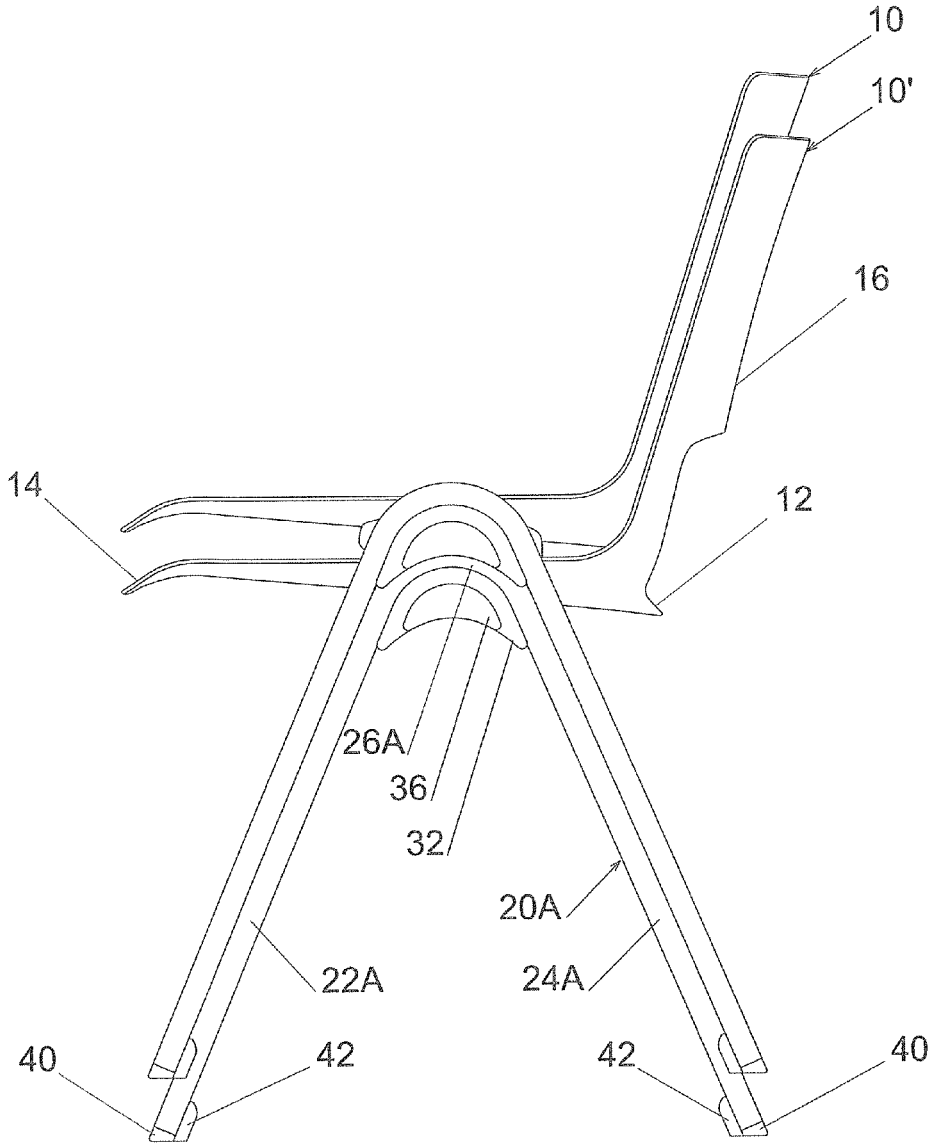
FIG. 2 shows a side view of the two chairs.
Figure 3:
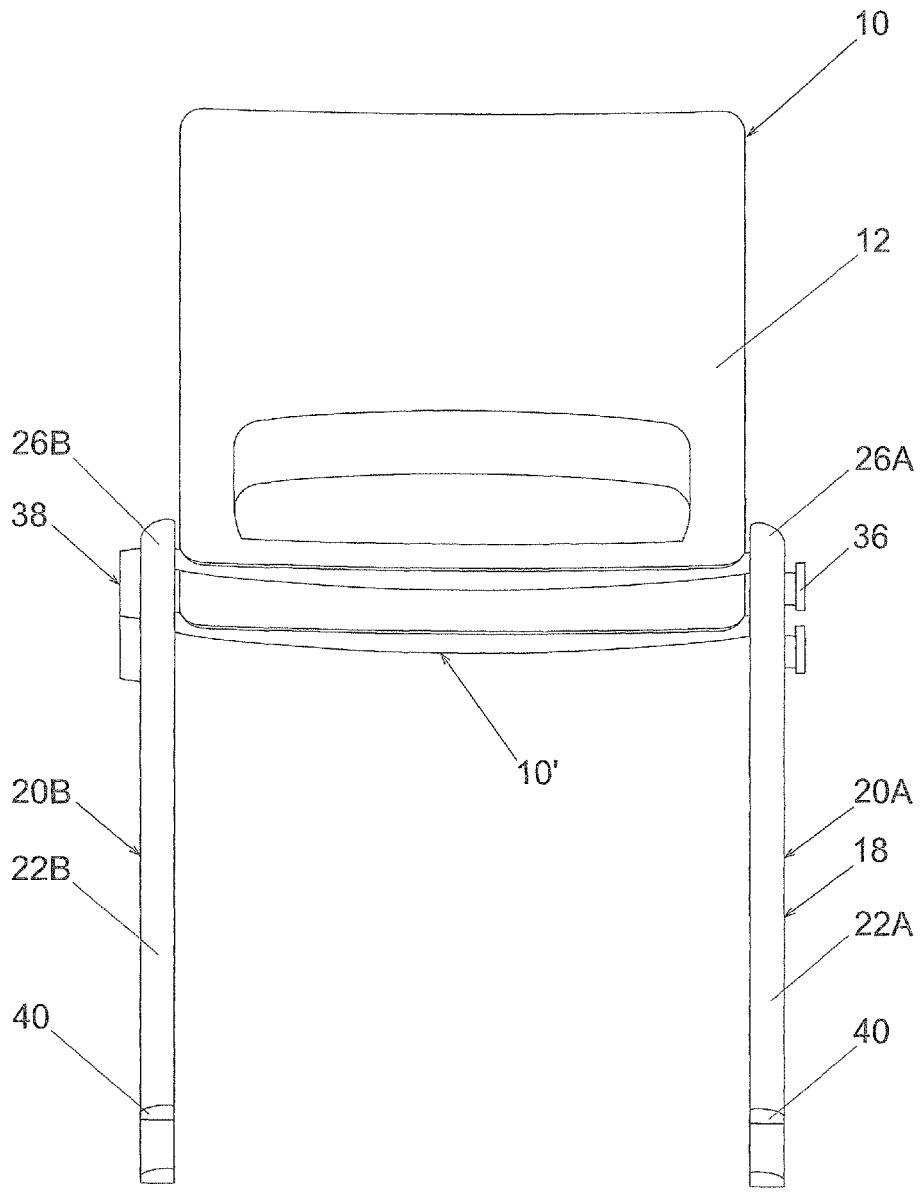
FIG. 3 shows a front view of the two chairs.

In FIGS. 1 to 5, two chairs 10 and 10' are shown each comprising a seat shell 12 which forms a seating element 14 and backrest element 16. The seat shell is arranged on a corresponding carrier frame 18 which is formed as a tubular construction and, regarding a vertical chair longitudinal meridian plane, comprises a leg element 20A and 20B on each of the two sides consisting of a curved tubular element which forms the front chair legs 22A and 22B, respectively, and the rear chair legs 24A and 24B, respectively. The chair legs 22A and 24A and the chair legs 22B and 24B, respectively, are connected via a respective upper curved section 26A or 26B of the corresponding tubular element and diverge at the bottom, i.e. in direction of the floor area, in a V-shape, wherein parallel planes are spanned from the chair leg elements 20A and 20B.

The tubular elements, of which the chair leg elements 20A and 20B are foil red, each have an in the broadest sense elliptic cross section with one long major axis and a short minor axis. Over the entire length of the corresponding tubular element, i.e. in the corresponding curved sections 26A and 26B as well, the long major axis of the ellipse formed by the cross section points upward in the direction of the vertical chair longitudinal meridian plane, so that the two chair leg elements 20A and 20B form a stacking help in shape of a cone with a downward opening. Since the chair leg elements 20A on one of the chair sides and the chair leg elements 20B on the other chair side (chairs 10 and 10' in the example shown) lie on top of each other, the chairs stacked on top of each other are secured in the chair transverse direction. Thus, the tubular elements are curved via an axis of the cross section ellipse arranged in the apex, said axis lying between the corresponding major axis and the corresponding minor axis and spanning an angle of preferably 45° and 60° with the major axis.

The major axis of the elliptic tubular element cross sections intersect the vertical chair longitudinal median plane in an angle of approximately 30° and 45° and does this over the entire length of the tubular elements.

Figure 4:
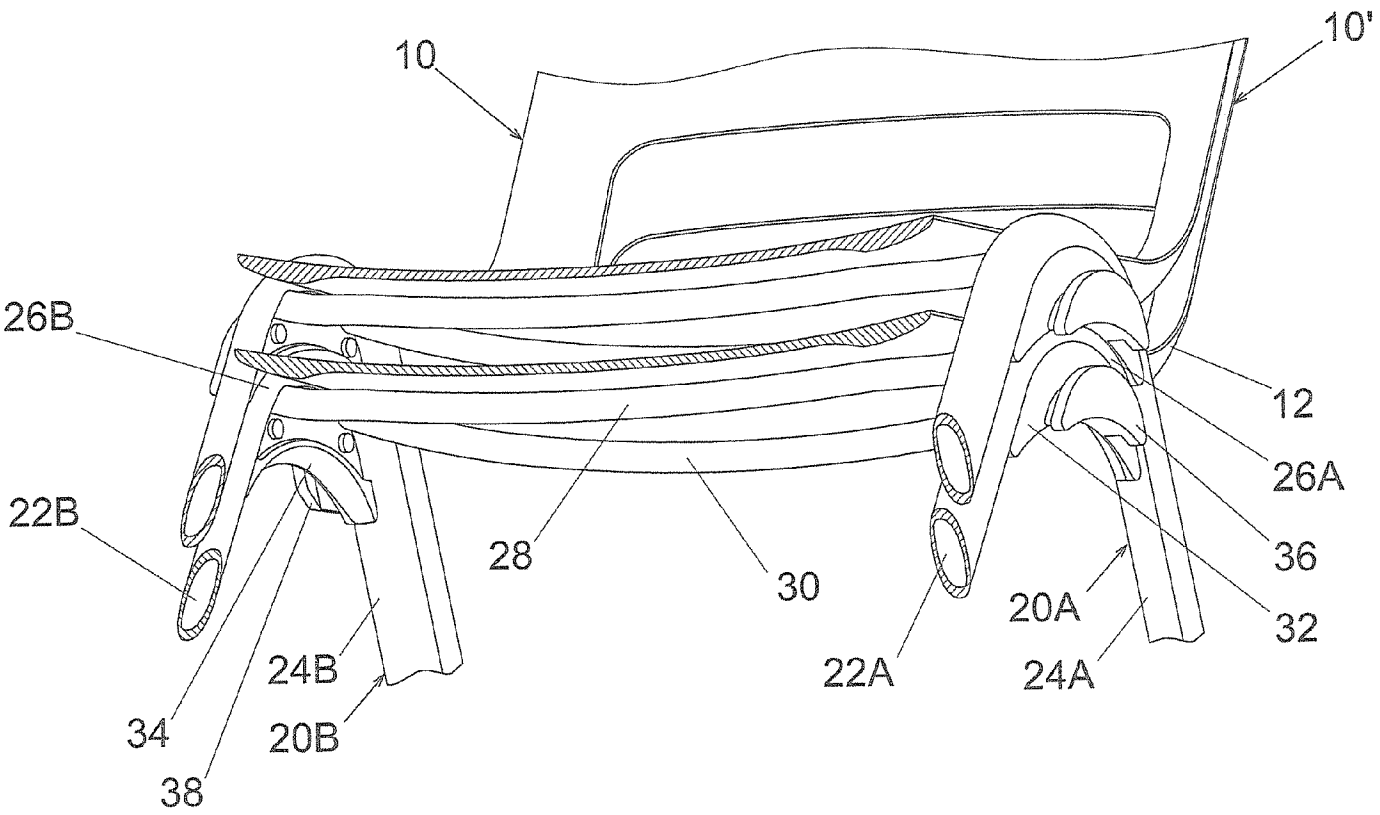
FIG. 4 shows a detail view of the chairs with crosscut legs.
Figure 5:
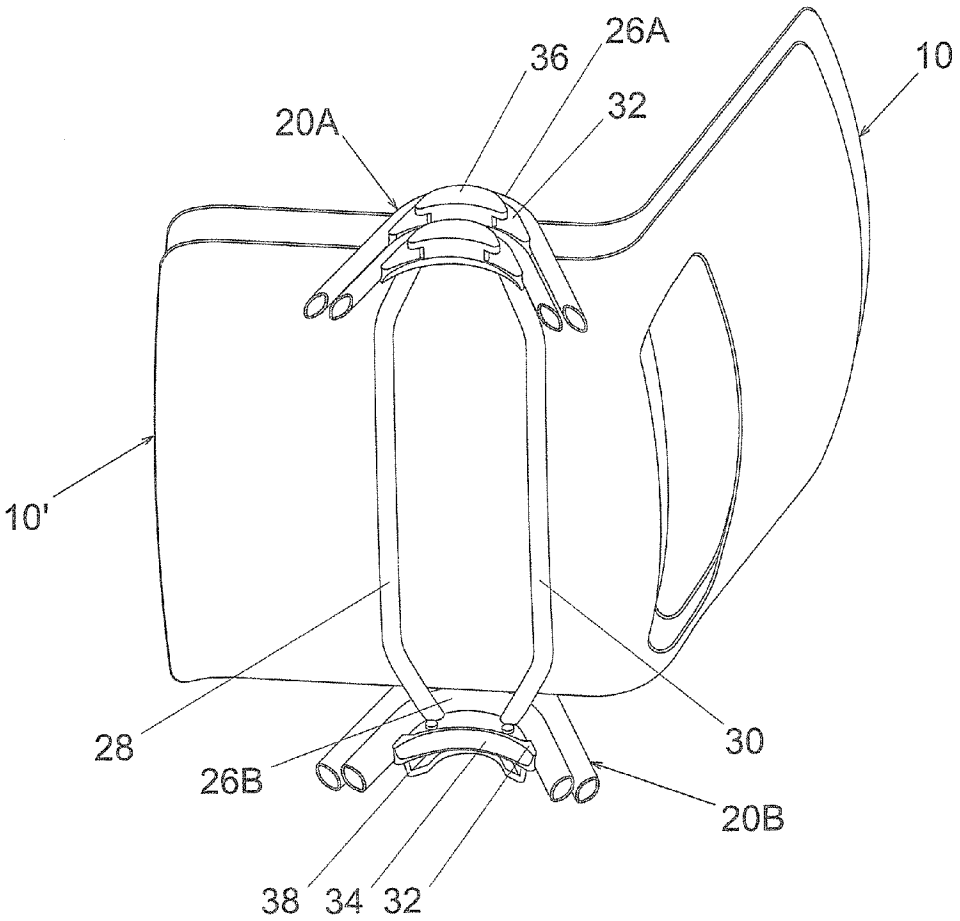
FIG. 5 shows a perspective bottom view of the chairs with crosscut legs.

As can be particularly seen in FIG. 4, the two laterally arranged chair leg elements 20A and 20B are connected to each other via two cross-pieces 28 and 30, which extend in the chair transverse direction and are each formed by a respective tubular element as well.

The curved sections 26A and 26B of the chair leg element 20A and 20B each encompass a stacking buffer 32 which lies with a contact surface 34 on the curved section 26A and 26B, respectively, of the chair leg elements 20A and 20B, respectively, of a frame furniture positioned underneath. The contact surface 34 has a form which is fitted to the outer surface of the corresponding curved section 26A and 26B. Furthermore, the stacking buffers 32 each have a linking element on the sides averted from the chair longitudinal median plane which in this case is formed as a protrusion 36 on the side of the chair leg element 20A and as a recess 38 on the side of the chair leg element 20B, fitting into the protrusion 38.

In the end area, the chair legs 22A, 22B, 24A and 24B each comprise a foot insert 40 made of plastic on which a stacking guide 42 made in one piece with the foot insert 40 is provided along the inside of the chair leg. The stacking guides 42 lie on the outside of the respective chair leg when the chairs are stacked.

Figure 6:
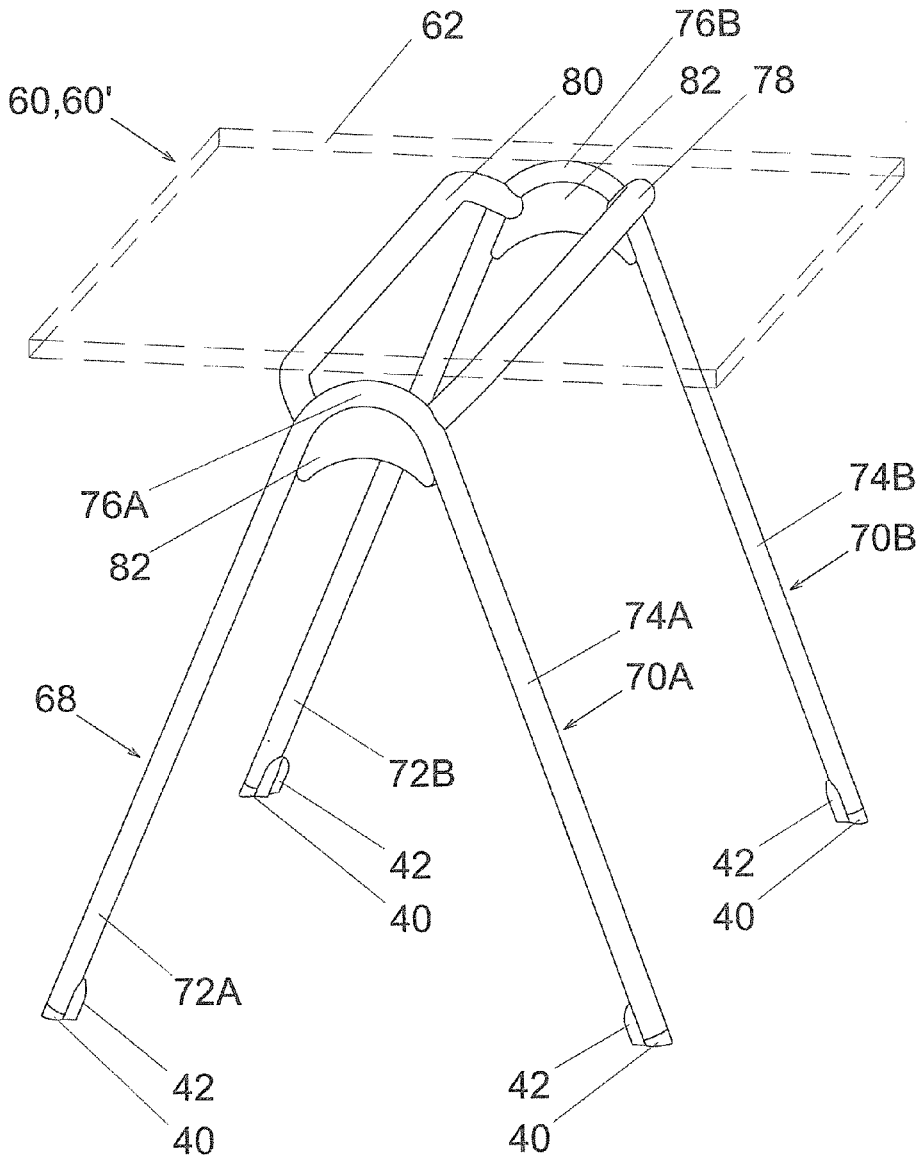
FIG. 6 shows a perspective view of a table according to the invention.
Figure 7:
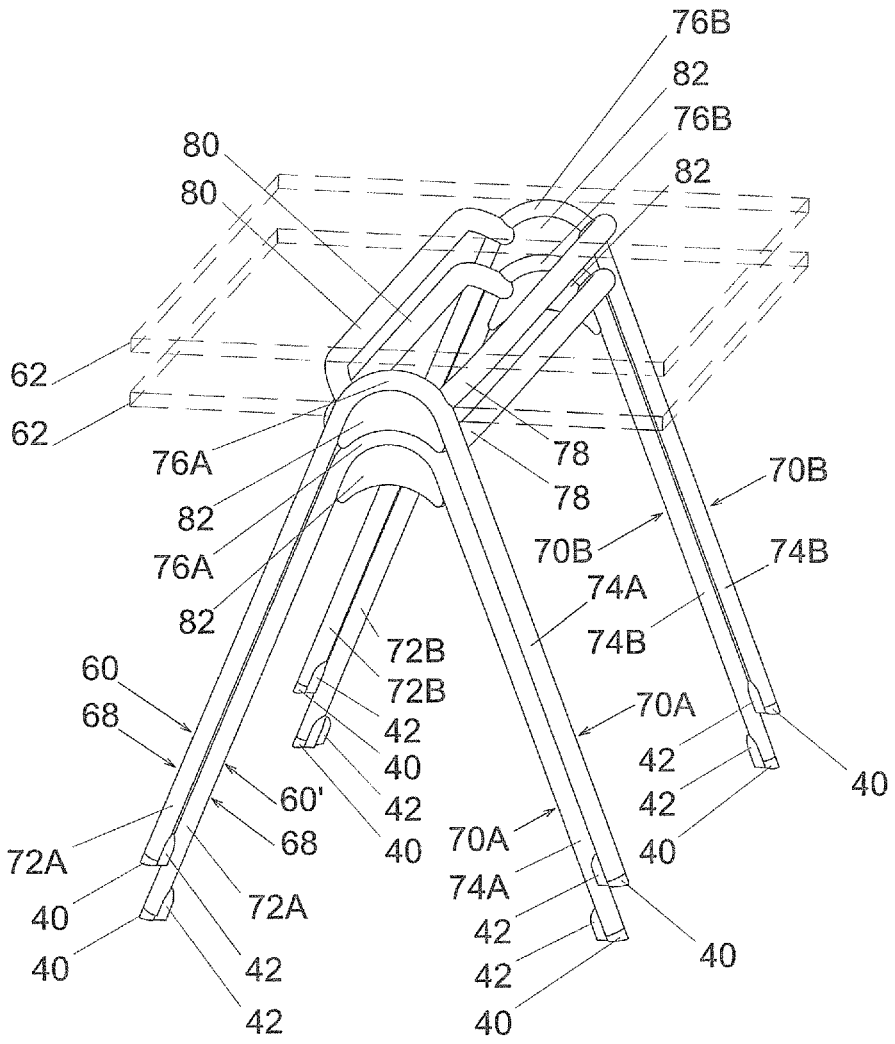
FIG. 7 shows two tables as shown in FIG. 6 when stacked.
Figure 8:
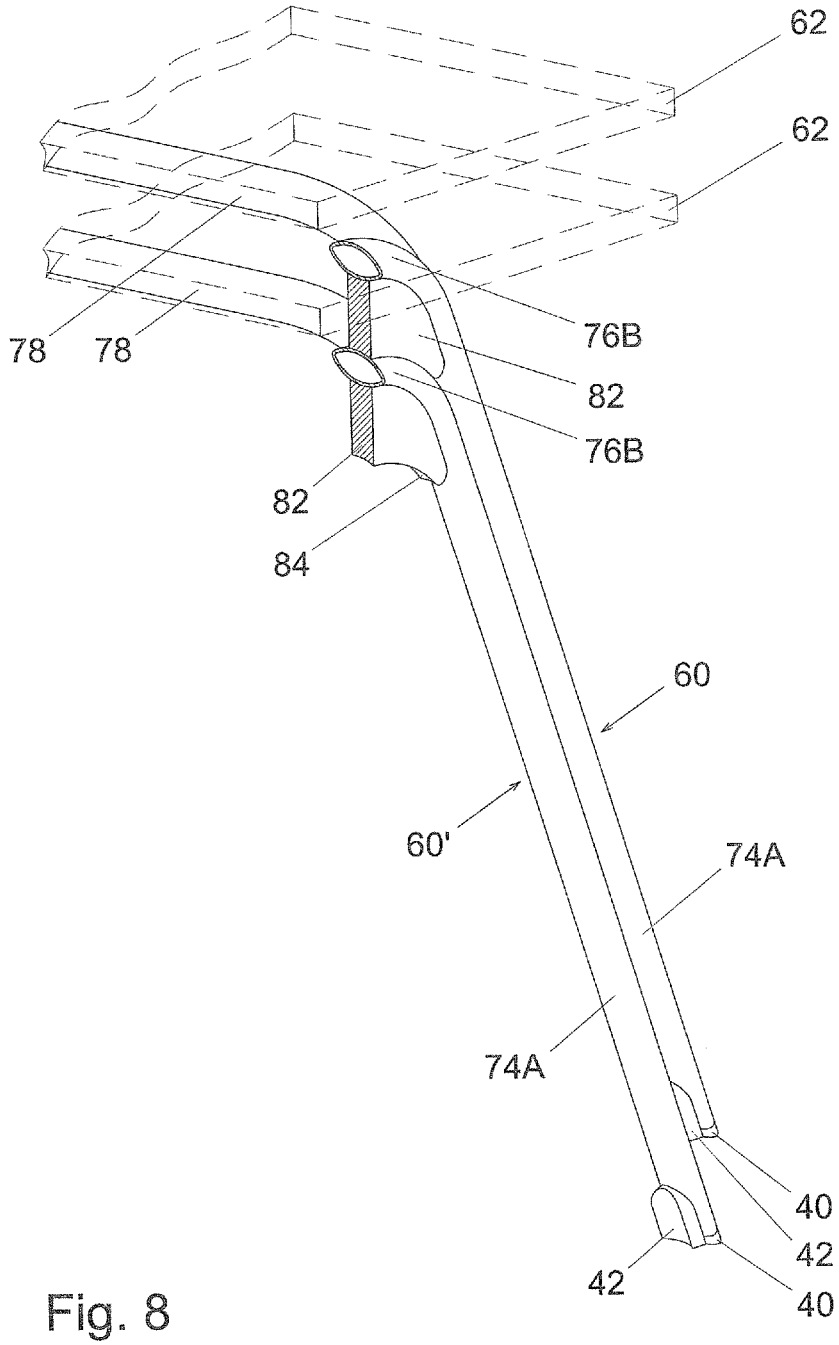
FIG. 8 shows the table frame of the table with crosscut table legs.

In FIGS. 6 to 8, two tables 60 and 60' are shown, which each comprise a tabletop 62 arranged on a carrier frame 68. The carrier frame 68 is formed as a tubular construction and, regarding a vertical table meridian plane, comprises a leg element 70A and 70B on each of the two sides consisting of a curved tubular element which forms the table legs 72A and 74A and the table legs 72B and 74B, respectively. The table legs 72A and 74A on the one hand and the table legs 72B and 74B on the other hand are each connected via an upper curved section 76A or 76B of the corresponding tubular element and diverge at the bottom, i.e. in direction of the floor area, in a V-shape, wherein parallel planes are spanned from the table leg elements 70A and 70B.

The tubular elements, of which the chair leg elements 70A and 70B are formed, each have an in the broadest sense elliptic cross section with one long major axis and a short minor axis. Over the entire length of the corresponding tubular element, i.e. in the corresponding curved sections 76A and 76B as well, the long major axis of the ellipse formed by the cross section points upward in the direction of the vertical table meridian plane, so that the two table leg elements 70A and 70B toms a stacking help in shape of a cone with a downward opening. Since the table leg elements 70A on one of the table sides and the table leg elements 70B on the other table side lie on top of each other, the tables stacked on top of each other, as shown in FIGS. 7 and 8, are secured in the table transverse direction. Thus, the tubular elements are curved via an axis of the cross section ellipse arranged in the apex, said axis lying between the corresponding major axis and the corresponding minor axis and spanning an angle of preferably 45° and 60° with the major axis.

The major axis of the elliptic tubular element cross sections intersect the vertical table median plane in an angle of approximately 30° and 45° and does this over the entire length of the tubular elements. The two laterally arranged table leg elements 70A and 70B are connected to each other via two cross-pieces 78 and 80, which extend in the table median plane and are each formed by a tubular element as well.

The curved sections 76A and 76B of the table leg element 70A and 70B each encompass a stacking buffer 82 which lies with a contact surface 84 on the curved section 76A and 76B, respectively, of the table leg elements 70A and 70B, respectively, of a table positioned underneath. The contact surface 84 has a form which is fitted to the outer surface of the corresponding curved section 76A and 76B.

In the end area, the table legs 72A, 72B, 74A and 74B each comprise a foot insert 40 made of plastic in which a stacking guide 42 made in one piece with the foot insert 40 is aligned along the inside of the chair leg. The stacking guides lie on the outside of the corresponding chair leg when the chairs are stacked.

The invention claimed is:

1. A frame furniture comprising a furniture element (14) being plate-shaped at least in some areas and having an at least partially nearly horizontal extension and being arranged on a carrier frame (18) which has a leg element (20A, 20B) on each of two sides of a longitudinal vertical furniture median plane, the leg element (20A, 20B) being a tubular element bent in such a way that the tubular element forms a front and rear furniture leg (22A, 22B, 24A, 24B), wherein the tubular elements each have an elliptical or oval cross section having a long major axis and a short minor axis, wherein the major axis and the minor axis intersect with the vertical furniture median plane over the length of the particular tubular element at an angle of less than 90°.

2. The frame furniture according to claim 1, wherein the major axis points upward in direction of the furniture median plane over the length of the corresponding tubular element and the minor axis points downward in direction of the furniture median plane.

3. The frame furniture according to claim 1, wherein the major axis intersects the vertical furniture median plane at an angle between 30° and 60°.

4. The frame furniture according to claim 1 wherein the furniture legs (22A, 22B, 24A, 24B) of each leg element (20A, 20B), which are formed from the same tubular element, diverge in direction of a floor area.

5. The frame furniture according to claim 1, wherein the frame furniture is a table and that the furniture element is a tabletop.

6. The frame furniture according to claim 1, wherein the two leg elements (20A, 20B) span at least largely parallel planes.

7. The frame furniture according to claim 1, wherein the frame furniture is a chair and the furniture element is a seating element.

8. The frame furniture according to claim 1, wherein the leg elements (20A, 20 B) are connected to each other via at least one cross-piece (28, 30).

9. The frame furniture according to claim 8, wherein the furniture element (14) is fixed on the at least one cross piece (18, 30).

10. The frame furniture according to claim 1, wherein the furniture legs (22A, 22B, 24A, 24B) comprise at least one stacking guide (42) at their end sections, said at least one stacking guide (42) abutting to the leg ends (22A, 22B, 24A, 24B) of a frame furniture of the same make when stacked.

11. The frame furniture according to claim 10, wherein said at least one stacking guide (42) is produced in one piece with the corresponding furniture leg end (40).

12. The frame furniture according to claim 1, wherein a curved section (26A; 26B) of the corresponding tubular element lies between the furniture legs (22A, 24A; 22B, 24B) of the corresponding leg element (20A; 20B).

13. The frame furniture according to claim 12, wherein the curved section (26A; 26B) encompasses a stacking buffer (32).

14. The frame furniture according to claim 12, wherein a stacking buffer (32) forms a linking element with which the frame furniture can be linked with other frame furniture of the same make.

* * * * *